US010227964B2

(12) United States Patent
Graf et al.

(10) Patent No.: US 10,227,964 B2
(45) Date of Patent: Mar. 12, 2019

(54) HYDRAULIC PUMP PORT PLATE WITH VARIABLE AREA METERING NOTCH

(71) Applicant: Caterpillar Inc., Peoria, IL (US)

(72) Inventors: Kevin J. Graf, Chillicothe, IL (US); Kaimei Sun, Peoria, IL (US); Hongliu Du, Naperville, IL (US)

(73) Assignee: Caterpillar Inc., Deerfield, IL (US)

( * ) Notice: Subject to any disclaimer, the term of this patent is extended or adjusted under 35 U.S.C. 154(b) by 674 days.

(21) Appl. No.: 14/839,128

(22) Filed: Aug. 28, 2015

(65) Prior Publication Data

US 2017/0058876 A1 Mar. 2, 2017

(51) Int. Cl.

| | |
|---|---|
| ***F04B 1/20*** | (2006.01) |
| ***F04B 1/30*** | (2006.01) |
| *F04B 1/18* | (2006.01) |
| *F04B 1/32* | (2006.01) |

(52) U.S. Cl.

CPC ..... *F04B 1/2042* (2013.01); *F04B 1/205* (2013.01); *F04B 1/2021* (2013.01); *F04B 1/2057* (2013.01); *F04B 1/303* (2013.01); *F04B 1/32* (2013.01); *F04B 1/188* (2013.01); *F04B 1/324* (2013.01)

(58) Field of Classification Search

CPC ..... F04B 1/2042; F04B 1/205; F04B 1/2057; F04B 1/2021; F04B 1/32; F04B 1/303

See application file for complete search history.

(56) References Cited

U.S. PATENT DOCUMENTS

| | | | | |
|---|---|---|---|---|
| 3,956,969 | A * | 5/1976 | Hein | F04B 1/2042 91/487 |
| 4,175,472 | A * | 11/1979 | Roberts | F04B 1/30 91/499 |
| 5,555,726 | A * | 9/1996 | Huebner | F04B 1/2042 417/282 |
| 5,572,919 | A * | 11/1996 | Ishizaki | F04B 1/2021 417/270 |
| 5,992,454 | A | 11/1999 | Schrag | |
| 6,086,336 | A * | 7/2000 | Welschof | F04B 1/2042 417/308 |
| 6,736,048 | B2 * | 5/2004 | Riedhammer | F04B 1/2042 417/269 |
| 7,121,187 | B2 | 10/2006 | Holder | |
| 8,047,120 | B2 * | 11/2011 | Shinohara | F04B 1/2042 417/269 |
| 2011/0271829 | A1 | 11/2011 | Kadlicko | |

FOREIGN PATENT DOCUMENTS

| | | |
|---|---|---|
| WO | WO 2005/116457 A1 | 12/2005 |
| WO | WO 2012/162487 A2 | 11/2012 |

* cited by examiner

*Primary Examiner* — Peter J Bertheaud

(74) *Attorney, Agent, or Firm* — Leydig, Voit & Mayer, Ltd.

(57) ABSTRACT

A port plate for a swashplate type axial piston pump is described herein. The port plate includes an inlet port, a discharge port, and a first metering notch in fluidic communication via a first passage with a metering notch area adjustment valve configured to adjust the effective area of the metering notch. The first metering notch is disposed at a leading edge of one of the inlet port or the discharge port.

20 Claims, 7 Drawing Sheets

HYDRAULIC PUMP PORT PLATE WITH VARIABLE AREA METERING NOTCH

FIELD

This patent disclosure relates generally to hydraulic pumps and, more particularly, to an interface between a pumping chamber of a hydraulic pump and intake and discharge lines connected thereto.

BACKGROUND

Hydraulic pumps compress and move hydraulic fluids by mechanical action in order to generate and transmit power. In hydraulic tool systems, hydraulic pumps provide high-pressure fluid to various actuators that transmit forces necessary to perform work. The actuators of such hydraulic tool systems often require that hydraulic fluid be provided at different flow rates and pressures for proper function. Variable displacement pumps can be utilized to accommodate the varied flow rate and pressure requirements, both individually and collectively, of the multiple actuators of hydraulic tool systems.

Swashplate-type axial piston pumps are variable displacement pumps commonly used in hydraulic tool systems. Swashplate-type axial piston pumps include a plurality of plungers having one end held against an engagement surface of a tiltable swashplate. A ball-and-socket slipper joint is provided at the interface between each plunger end and the engagement surface of the swashplate to allow for relative sliding and pivoting motion. Each plunger reciprocates within an associated cylinder as the plungers rotate relative to the tilted engagement surface of the swashplate. When a plunger is retracted from an associated cylinder, low-pressure fluid is drawn into that chamber. When the plunger is forced back into the cylinder by the engagement surface of the swashplate, the plunger pushes fluid from the cylinder at an elevated pressure.

Each cylinder and associated plunger together at least partially form a pumping chamber configured to intake hydraulic fluid from an inlet passage and to discharge hydraulic fluid into an outlet passage. Each pumping chamber interfaces with the inlet passage and the outlet passage through a port plate. The port plate includes an inlet port through which hydraulic fluid is drawn from the inlet passage into the pumping chamber and an outlet port through which hydraulic fluid is expelled from the pumping chamber into the outlet passage. As a plunger of a pumping chamber moves from a top-dead-center (TDC) position at the end of a discharge stroke to a bottom-dead-center position at the end of an intake stroke, the plunger passes the inlet port as it rotates relative to the port plate. As a plunger of a pumping chamber moves from a bottom-dead-center (BDC) position at the end of an intake stroke to a top-dead-center position at the end of a discharge stroke, the plunger passes the outlet port as it rotates relative to the port plate.

The tilt angle of the swashplate is directly related to an amount of fluid pushed from each cylinder during a single relative rotation between the plungers and the swashplate. Similarly, based on a restriction of a fluid circuit connected to the pump, the amount of fluid pushed from the cylinder during each rotation is directly related to the flow rate and pressure of fluid exiting the pump. Accordingly, a higher swashplate tilt angle of a pump equates to a greater flow rate and/or pressure of the pump, while a lower swashplate tilt angle results in a lower flow rate and/or pressure. Likewise, a higher swashplate tilt angle requires more power to produce the higher flow rates and pressures than does a lower swashplate tilt angle. As such, when the demand for fluid from the hydraulic tool system is low, the swashplate angle is typically reduced to lower the power consumption of the pump.

SUMMARY

In one aspect, the disclosure describes a port plate for a swashplate type axial piston pump. The port plate includes a port plate body, an inlet port extending through the port plate body, a discharge port extending through the port plate body, and a first metering notch comprising a channel in the port plate body, the first metering notch being in fluidic communication via a first area adjustment passage with a first area adjustment valve configured to adjust the effective area of the metering notch. The first metering notch is disposed at a leading edge of one of the inlet port or the discharge port.

In another aspect, the disclosure describes a swashplate-type axial piston pump. The swashplate-type axial piston pump includes a swashplate, a plurality of pumping chambers, and a port plate. Each pumping chamber includes a plunger connected to the swashplate via a slipper foot configured to slide along a plunger engagement surface of the swashplate, and a pumping chamber barrel in which an associated plunger undergoes reciprocal motion. The port plate includes a port plate body, an inlet port extending through the port plate body, a discharge port extending through the port plate body, and a first metering notch comprising a channel in the port plate body, the first metering notch being in fluidic communication via a first area adjustment passage with a first area adjustment valve configured to adjust the effective area of the metering notch. The metering notch is disposed at a leading edge of one of the inlet port or the discharge port.

In yet another aspect, the disclosure describes a method for operating a swashplate-type axial piston pump, the method comprising rotating a pumping chamber about a central axis of the swashplate-type axial piston pump and towards an inlet port of a port plate, adjusting an effective area of an inlet port metering notch by controlling an inlet port metering notch area adjustment valve actuator, rotating the pumping chamber across the inlet port metering notch and into fluidic communication with the inlet port, and rotating the pumping chamber across the inlet port while drawing fluid through the inlet port and into the pumping chamber.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

This disclosure provides an interface between a pumping chamber of a hydraulic pump and intake and discharge lines connected thereto. More specifically, this disclosure provides a port plate for utilization in a swashplate-type axial piston pump, the port plate having intake and discharge ports and at least one metering notch with an effective area adjustment mechanism connected to a leading edge of at least one of the intake and discharge ports. The metering notch effective area adjustment mechanism allows the effective area of the metering notch to be adjusted in order to improve performance of the swashplate-type axial piston pump under various operating conditions. Furthermore, by allowing the effective area of the metering notch to be increased beyond its actual area (e.g. the area of a groove machined into the port plate), the metering notch effective area adjustment mechanism can increase the range of pressures at which the swashplate-type axial piston pump can be operated.

Figure 1:
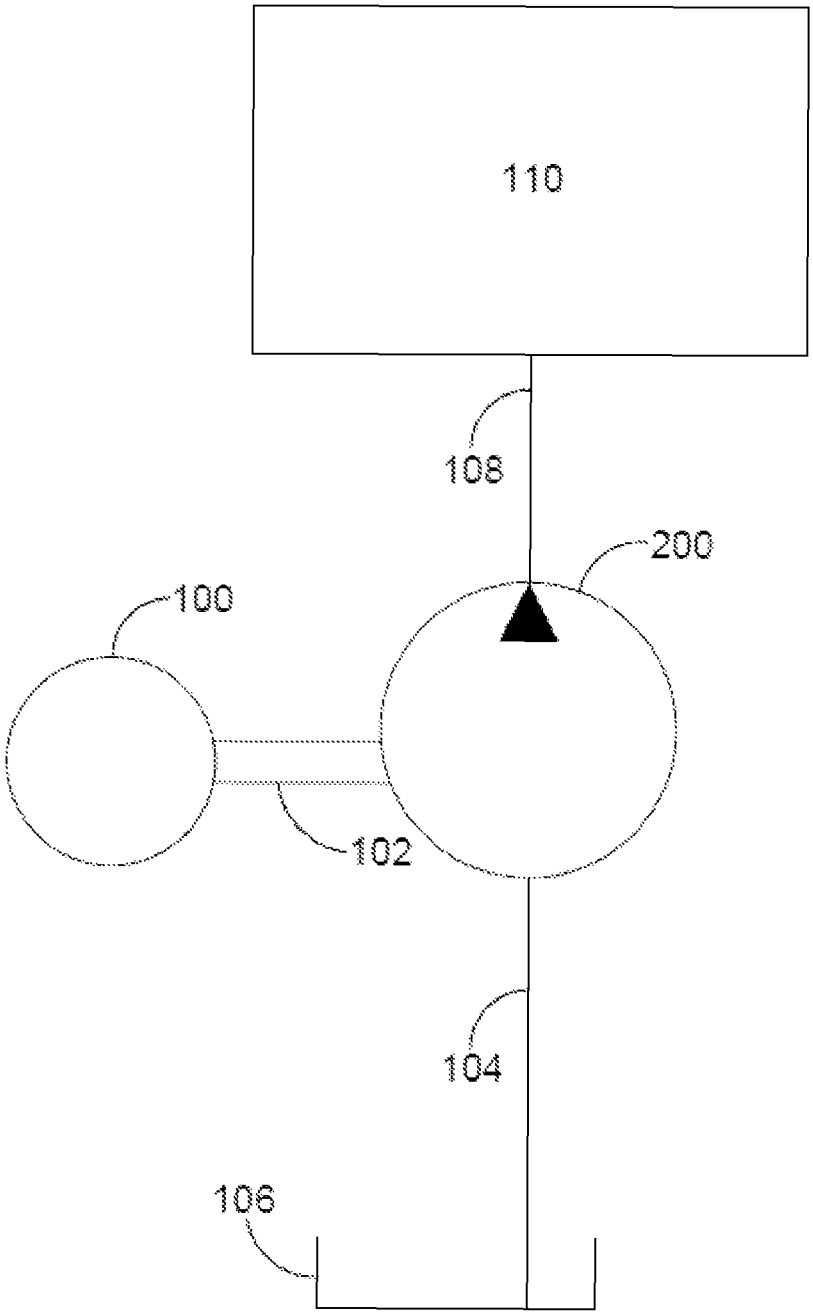
FIG. 1 is a schematic illustration of an embodiment of a hydraulic circuit in accordance with the disclosure.

FIG. 1 is a schematic illustration of an embodiment of a hydraulic circuit in accordance with the disclosure. The hydraulic circuit includes an engine, or motor, 100 that provides power to a pump 200, which includes a collection of components that are driven by the engine 100 in order to provide power to hydraulic actuators and tool systems 110. The pump 200 is fluidly connected to a low pressure tank 106 via an inlet passage 104 and is fluidly connected to the hydraulic actuators and tool systems 110 via outlet passage 108. In this manner, as the engine 100 provides power to the pump 200, the pump 200 draws hydraulic fluid from the low pressure tank 106 through the inlet passage 104 and into one or more pumping chambers. The pump 200 then discharges (e.g. at an elevated pressure) the hydraulic fluid from the one or more pumping chambers through the outlet passage 108 in order to power the hydraulic actuators and tool systems 110. Valves and other components controlling the flow of hydraulic fluid in the system 110 are not shown for simplicity.

Figure 2:
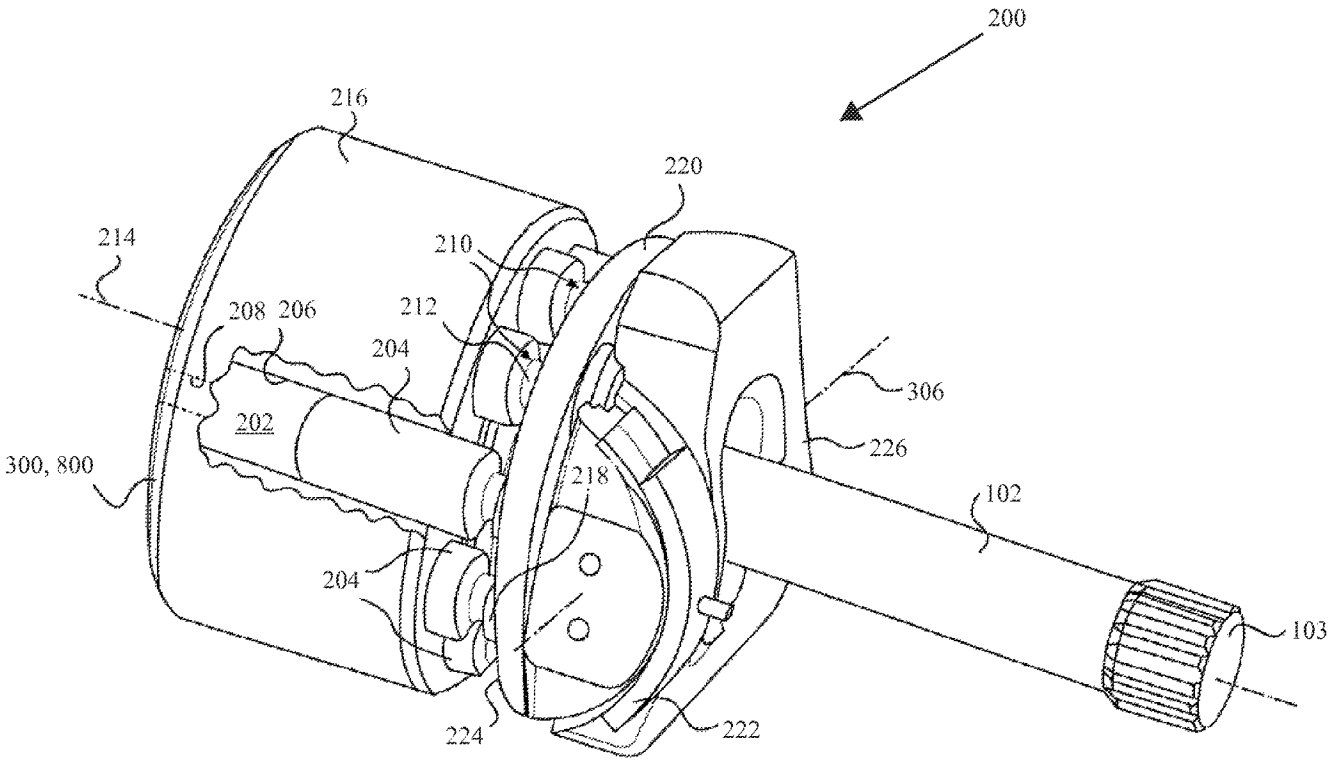
FIG. 2 is a schematic illustration of an embodiment of a pump that may form a portion of the hydraulic circuit of FIG. 1 in accordance with the disclosure.

FIG. 2 is a schematic illustration of an embodiment of a pump that may form a portion of the hydraulic circuit of FIG. 1 in accordance with the disclosure. Pump 200 can be driven by the engine 100 via the driveshaft 102. As illustrated in FIG. 2, the driveshaft 102 may include a splined interface 103 for connection with engine 100, for example with a gear train (not shown) of engine 100. The pump 200 includes a body 216 that at least partially defines a plurality of pumping chamber barrels 206 (of which only one is shown). Pump 200 may also include a plurality of plungers 204, one plunger 204 slidingly disposed within each barrel 206. Each barrel 206 and each associated plunger 204 may together at least partially form a pumping chamber 202 configured to receive and discharge fluid by way of a port plate 300. It is contemplated that any number of pumping chambers 202 may be included within body 216 and be symmetrically and radially disposed about a central axis 214. Although central axis 214 is shown as being generally coaxial with driveshaft 102, it is contemplated that central axis 214 may alternatively, if desired, be oriented at an angle relative to driveshaft 102, such as in a bent-axis type pump.

Body 216 may be connected to rotate with driveshaft 102. That is, as driveshaft 102 is rotated by engine 100, body 216 and plungers 204 located within barrels 206 of body 216 may all rotate together about central axis 214. As body 216 rotates, individual passageways 208 associated with each pumping chamber 202 pass by inlet and discharge ports of port plate 300 (or of rotatable port plate 800) to draw in and expel pressurized fluid. As a pumping chamber 202 rotates with body 216, an associated individual passageway 208 moves into fluidic communication with an inlet port 302 of the port plate 300 (or an inlet port 802, in the case of the rotatable port plate 800) at the beginning of an intake stroke. The pumping chamber 202 then draws fluid in as the associated passageway 208 rotates across the inlet port 302 (or the inlet port 802) until it is no longer in fluidic communication with the inlet port 302 (or the inlet port 802). Similarly, as a pumping chamber 202 rotates, an associated individual passageway will, at some point in the rotational cycle, move into fluidic communication with a discharge port 304 of the port plate 300 (or a discharge port 804 of the rotatable port plate 800) at the beginning of a discharge stroke. The pumping chamber 202 then continually expels fluid through the discharge port as the associated passageway rotates across the discharge port 304 (or the discharge port 804) until it moves out of fluidic communication with the discharge port 304 (or the discharge port 804).

Pump 200 includes a generally stationary swashplate 220 having a plunger engagement surface 224 and a tiltable base 226. Plunger engagement surface 224 may be located between plungers 204 and tiltable base 226 to operatively engage plungers 204 by way of a ball and socket plunger engagement joint 210. That is, each plunger 204 may have a generally spherical end 212, which may be biased into engagement with a cup-like socket located within a slipper foot 218. Slipper feet 218 may be configured to slide along plunger engagement surface 224, which may be connected to or otherwise integral with tiltable base 226.

Swashplate 220 may be selectively tilted to vary a stroke of plungers 204 within barrels 206 (i.e., a displacement of plungers 204). Specifically, tiltable base 226 may be situated within a bearing member 222 and pivotal about a tilt axis 306 (or in the case of the rotatable port plate 800, a tilt axis 806). In one embodiment, swashplate tilt axis 306 (which corresponds to tilt axis 806 in the case of the rotatable port plate 800) may pass through and be substantially perpendicular to central axis 214. As tiltable base 226 and connected plunger engagement surface 224 pivot about tilt axis 306, the plungers 204 located on one half of plunger engagement surface 224 (relative to tilt axis 306 or tilt axis 806) may retract into their associated barrels 206, while the plungers 204 located on an opposing half of plunger engagement surface 224 may extend out of their associated barrels 206 by about the same amount. As plungers 204 rotate about central axis 214, plungers 204 may annularly move from the retracted side of plunger engagement surface 224 to the extended side, and repeat this cycle as driveshaft 102 continues to rotate.

As plungers 204 move out of barrels 206, fluid may be drawn into chambers 202. Conversely, as plungers 204 are forced back into barrels 206, the fluid may be discharged from chambers 202 at an elevated pressure. An amount of movement between the retracted and extended positions may relate to an amount of fluid displaced by plungers 204 during a single rotation of driveshaft 102. Because of the connection between plungers 204 and plunger engagement surface 224, the tilt angle of plunger engagement surface 224 may relate to the displacement of plungers 204. One or more pressure relief valves (not shown) located within pump 200 or within outlet passage 108 (referring to FIG. 1) may affect the pressure of the fluid discharged from pumping chambers 202.

Figure 3:
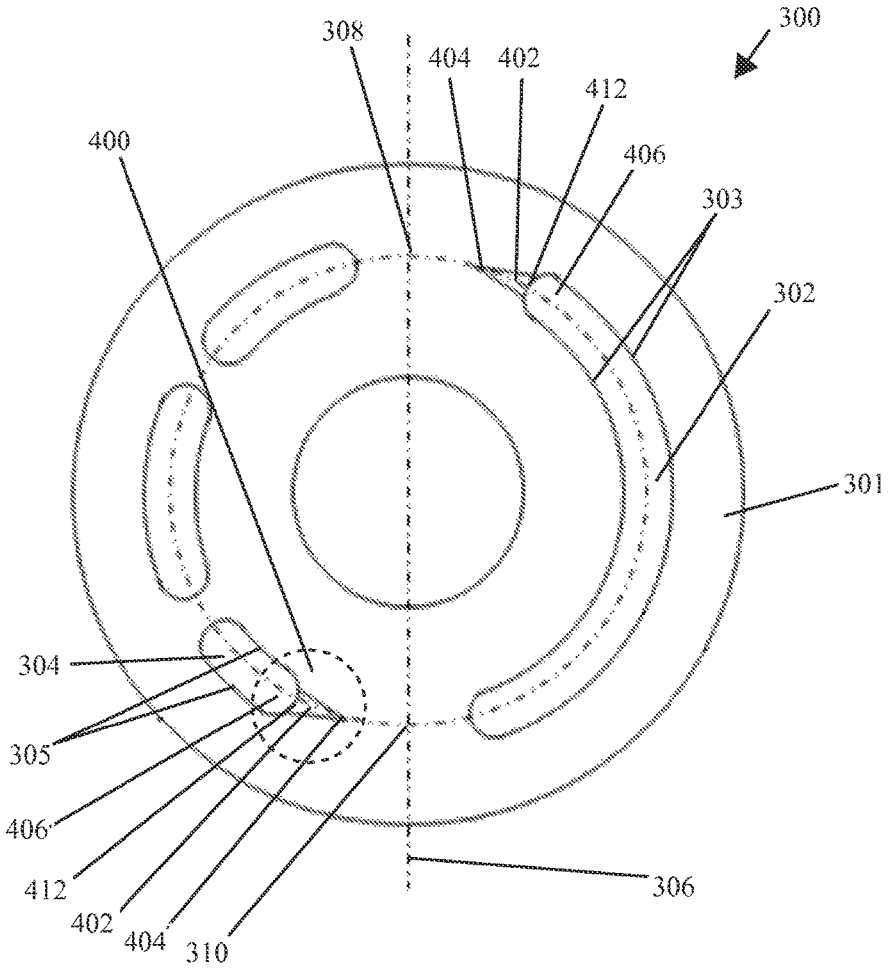
FIG. 3 is a schematic illustration of an embodiment of a port plate that may form a portion of the pump of FIG. 2 in accordance with the disclosure.

FIG. 3 is a schematic illustration of an embodiment of a port plate that may form a portion of the pump of FIG. 2 in accordance with the disclosure. Port plate 300 includes a port plate body 301, which, from the perspective of FIG. 3, extends into or out of the page. Port plate 300 further includes a generally arcuate inlet port 302 located within one half of port plate 300 relative to tilt axis 306, and a similar generally arcuate discharge port 304 located within an opposing half of port plate 300. The discharge port 304 may be continuous or may consist of multiple discrete segments (as depicted in FIG. 3). The inlet port 302 includes side walls 303 that extend into, and in some embodiments completely through, the thickness of the port plate body 301. Similarly, the discharge port 304 includes side walls 305 that extend into, and in some embodiments completely through, the thickness of the port plate body 301. A metering notch 402 may be provided at a leading edge 406 of each of inlet port 302 and discharge port 304. As body 216 and associated pumping chambers 202 rotate relative to port plate 300 (e.g., rotate clockwise in FIG. 3), passageways 208 may move into and out of fluid communication with inlet port 302 and discharge port 304. Plungers 204 may reach a top-dead-center (TDC) position during a discharge stroke at a transition area 308 located between a trailing end of discharge port 304 and a leading end of inlet port 302, and reach a bottom-dead-center (BDC) position during an intake stroke at a transition area 310 located between a trailing end of inlet port 302 and a leading end of discharge port 304. Transition areas 308 and 310 may generally be aligned with tilt axis 306.

Metering notches 402 may help to reduce a shock loading associated with the transitioning of the passageways 208 into and out of fluidic communication with each of the inlet port 302 and the discharge port 304. As passageways 208 of pumping chambers 202 move from a trailing edge of either of the inlet port 302 or the discharge port 304, through transition areas 308 and 310, and to a leading edge 406 of either of the inlet port 302 or the discharge port 304, a pressure spike may occur. Such pressure spikes, which occur at a frequency at which the pump is operated, can cause wear on various components, e.g., various seals and other components of the pump 200 as well as seals and other components of the hydraulic system to which the pump 200 is connected. Such pressure spikes can also prematurely wear or damage various pressure sensors located throughout the hydraulic system. Metering notches 402 can reduce the magnitude of such pressure shocks. Furthermore, metering notches 402 include effective area adjustment passages 404 that allow the effective area of the metering notch 402 to be increased, by various amounts, beyond the actual area of the metering notch 402, e.g. an area of a boundary between a groove, or channel, machined into the port plate body 301 and one of the inlet port 302 or the discharge port 304. A section of the port plate 300 is enlarged to show the metering notches 402 with increased detail.

Figure 4:
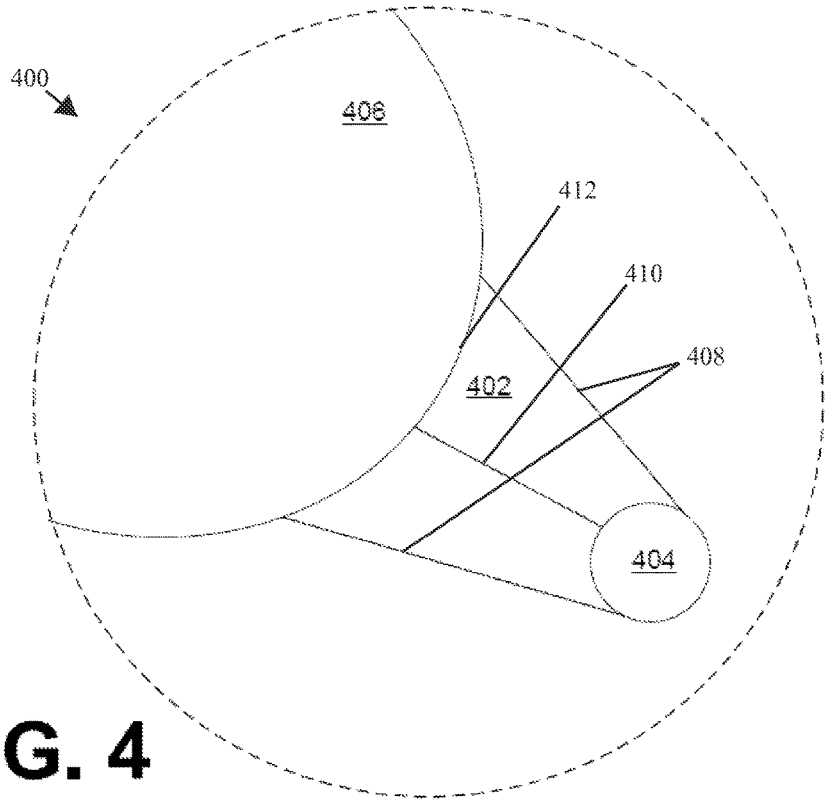
FIG. 4 is a schematic illustration of an embodiment of a metering notch that may form a portion of the port plate of FIG. 3 in accordance with the disclosure.

FIG. 4 is a detail view of an embodiment of a metering notch that may form a portion 400 of the port plate 300 of FIG. 3 or a portion 400 of the rotatable port plate 800 in FIG. 8 (described herein below) in accordance with the disclosure. The portion 400 of the port plate includes the metering notch 402, which abuts a leading edge 406 of any of the inlet port 302 or the discharge port 304 of the port plate 300 or the inlet port 802 or the discharge port 804 of the rotatable port plate 800. The metering notch 402 additionally includes an effective area adjustment passage 404. The effective area adjustment passage 404 is a fluidic connection to a metering notch area adjustment mechanism, which is depicted, e.g., in FIG. 5 herein below. The metering notch effective area adjustment mechanism, which can be, e.g., a pressure-controlled spool valve, provides for control of the effective area of the corresponding metering notch 402. In this manner, the effective area of the metering notches 402 can be matched with parameters of the pump 200 and parameters of the other components of a hydraulic system to which the pump 200 is connected in order to improve pump operation at the operating conditions specified by said parameters.

Each of the metering notches 402 includes a metering notch volume that, e.g., has been cut into either of the port plate body 301 or the port plate body 801. Therefore, the metering notch volume is a volume of material that has been removed from (or possibly never built into) the port plate body 301 or that has been removed from (or never built into) the port plate body 801. Each metering notch 402 further includes first and second metering notch sidewalls 408 and a metering notch base 410. In various embodiments, the first and second metering notch sidewalls 408 may extend inwards towards each other and meet along a line, such as is depicted in FIG. 4. In such instance, the line at which the first and second metering notch sidewalls meet forms the metering notch base 410. In alternative implementations, the first and second metering notch sidewalls 408 may terminate at various points along a plane that extends to the leading edge 406 of any of the inlet port 302 or the discharge port 304 or the inlet port 802 or the discharge port 804. In such instances, the plane in which the ends of the metering notch sidewalls 408 lie forms the metering notch base 410. Similarly, the metering notch sidewalls 408 may either slope linearly towards the metering notch base 410 or the metering notch sidewalls 408 may exhibit a degree of curvature as they extend from the top surface of the port plate body 301 into the port plate 300 or from the top surface of the port plate body 801 into the rotatable port plate 800. The top of the metering notch is formed by the extension of the top surface of the port plate body over the channel formed by the metering notch sidewalls 408 and the metering notch base 410. The metering notch-port boundary 412 extends between the volume formed by the channel or groove in either the port plate body 301 (or, in the case of the rotatable port plate 800, the port plate body 801) that forms the metering notch 402 and one of either the inlet port side walls 303 (or the inlet port side walls 803) or the discharge port side walls 305 (or the discharge port side walls 805).

Figure 5:
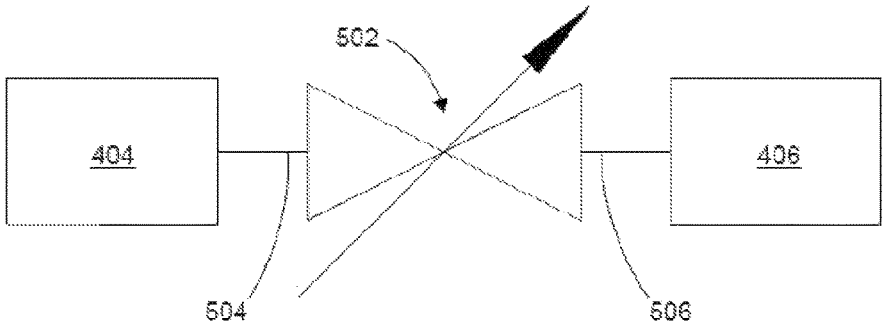
FIG. 5 is a schematic illustration of an embodiment of a metering notch effective area adjustment apparatus in accordance with the disclosure.

FIG. 5 is a schematic illustration of an embodiment of a metering notch effective area adjustment mechanism in accordance with the disclosure. The metering notch effective area adjustment mechanism includes a first adjustment passage (i.e. a first fluidic connection) 504 within first area adjustment passage enclosure 505 that allows for fluidic communication between the effective area adjustment passage 404 and area adjustment valve 502. The area adjustment valve 502 can be, in various embodiments, various different types of valves and can be, in various embodiments, opened and closed electronically, hydraulically, or otherwise. The area adjustment passage enclosure 505 can be a cylindrical wall or barrier and can be formed in a variety of shapes. In the embodiment depicted in FIG. 5, the metering notch effective area adjustment mechanism further includes a second adjustment passage (i.e. a second fluidic connection) 506 within second area adjustment passage enclosure 507 that allows for fluidic communication between the area adjustment valve 502 and the leading edge 406 of either the inlet port 302 or the discharge port 304. The metering notch effective area adjustment mechanism according to the embodiment of the schematic of FIG. 5 therefore provides for fluidic connection between the effective area adjustment passage 404 of the metering notch 402 and either the inlet port 302 or the discharge port 304. However, in alternative implementations, the second passage 506 of the metering notch effective area adjustment mechanism may be connected to a low pressure relief line, to a reservoir of hydraulic fluid, or to, e.g., either of the inlet passage 104 or the outlet passage 108. Similarly, the second passage 506 of the metering notch effective area adjustment may be connected to a reservoir of pressurized hydraulic fluid.

The area adjustment valve 502 can be electronically opened and closed, can be opened and closed hydraulically, or can be opened and closed through various other means. For example, the area adjustment valve can be a solenoid valve that is actuated through the application of electromagnetic current. The area adjustment valve 502 can be, in various embodiments, either shut (closed) so that no flow at all goes through, fully open for maximum flow, or sometimes partially open to any degree in between. The area adjustment valve 502 can therefore be a valve configured to be either open or shut, or the area adjustment valve can be a throttling, or metering, valve configured to regulate varying amounts of flow.

Figure 6A:
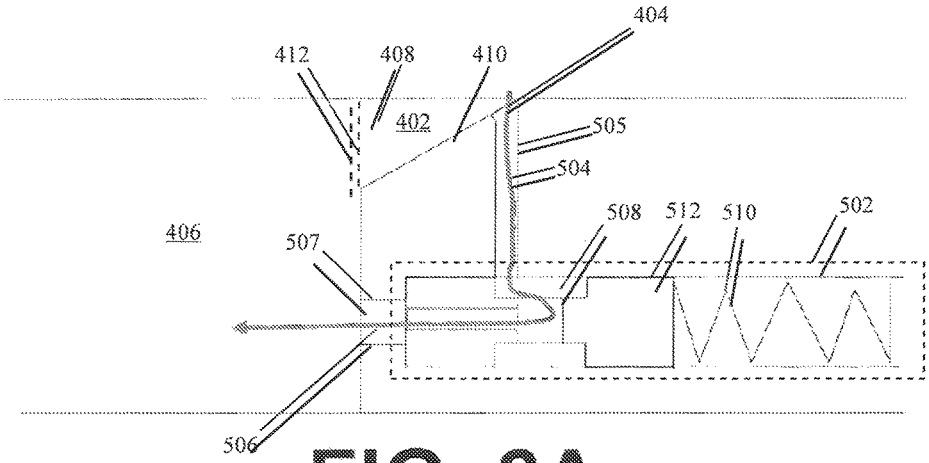
FIG. 6A is a schematic illustration of a valve in an open position that is connected to the metering notch of FIG. 4 in accordance with the disclosure.

FIG. 6A is a schematic illustration of a valve in an open position that is connected to the metering notch of FIG. 4 in accordance with the disclosure. The effective area adjustment passage 404 and the first passage 504 of the metering notch effective area adjustment mechanism provide for fluidic communication between the metering notch 402 and the area adjustment valve 502. In FIG. 6A, the area adjustment valve 502 is in an open position thereby providing for fluidic communication between the leading edge 406 (i.e., of either the inlet port 302 or the discharge port 304) and the metering notch 402 via the second passage 506 of the metering notch effective area adjustment mechanism, the area adjustment valve 502, and the first passage 504 of the metering notch effective area adjustment mechanism. In the embodiments depicted in FIGS. 6A and 6B, the area adjustment valve 502 is disposed in an internal cavity within the port plate 300. In alternative embodiments, the area adjustment valve 502 may be disposed externally to the port plate 300.

Figure 6B:
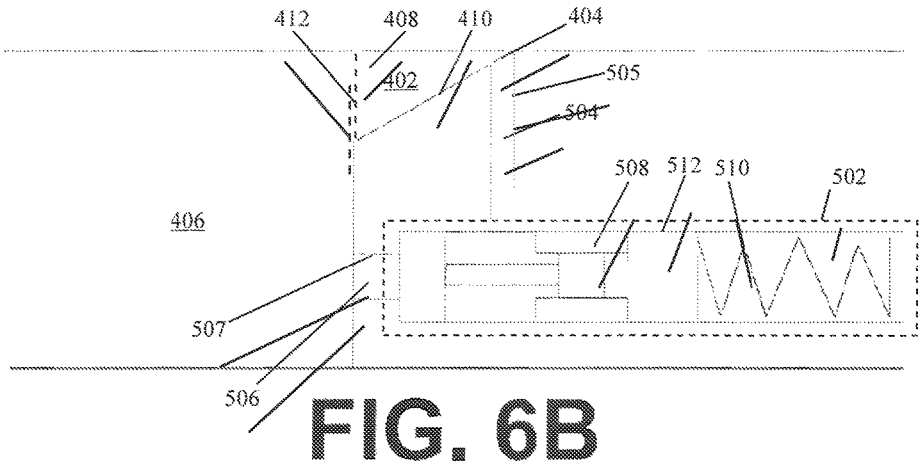
FIG. 6B is a schematic illustration of a valve in a closed position that is connected to the metering notch of FIG. 4 in accordance with the disclosure.

In the embodiment depicted in the FIG. 6A, the area adjustment valve 502 includes a valve spool 508 that is biased towards the leading edge 406 of the port by a spring 510. The spool 508 is configured to move back and forth within a valve spool housing 512 (i.e. toward or away from the leading edge 406). In the embodiment depicted in FIGS. 6A and 6B, fluid within the second passage 506 biases the spool 508 away from the leading edge 406 of the port and compresses the spring 510. In this manner, the pressurized fluid within the second passage 506 biases the area adjustment valve 502 into a closed position. In FIG. 6A, the pressure of fluid within the leading edge 406 of the port is insufficient to compress spring 510 and thereby close the area adjustment valve 502. In FIG. 6B, the pressure of the fluid within the leading edge 406 of the port is sufficient to compress spring 510 and thereby close the area adjustment valve 502. In FIG. 6A, the area adjustment valve 502 is in an open position as a result of the pressure of the pressurized fluid within the second passage 506 being below an opening threshold pressure. In FIG. 6B, the area adjustment valve 502 is in a closed position as a result of the pressure of the pressurized fluid within the second passage 506 being above a closing threshold pressure.

Figure 7:
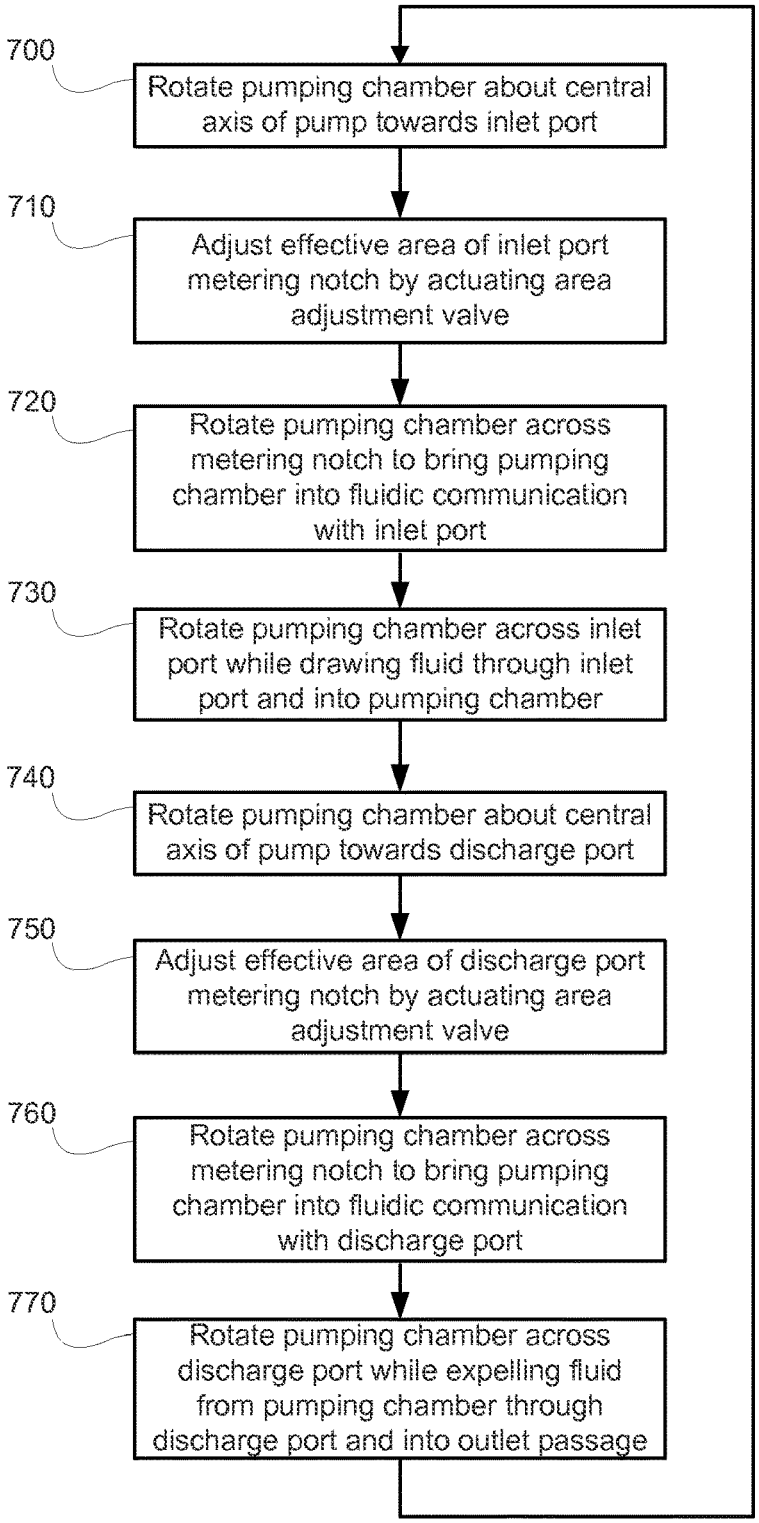
FIG. 7 is a flow diagram of a method for operating a pump having a metering notch effective area adjustment in accordance with the disclosure.

FIG. 7 is a flow chart of a method for operating a pump having a metering notch effective area adjustment in accordance with the disclosure. At step 700, a pumping chamber, such as pumping chamber 202, is rotated about the central axis 214 of the pump 200, and towards the inlet port 302 of the port plate 300. The method of FIG. 7 therefore contemplates that the pumping chamber begins at or near the bottom-dead-center (BDC) position. At step 710, the effective area of the inlet port metering notch 402 is adjusted by actuating the area adjustment valve 502. For example, the effective area of the inlet port metering notch 402 can be automatically adjusted as the result of the pressure of hydraulic fluid in communication with the inlet port metering notch 402 exerting a force on the valve spool 508 thereby causing the inlet port metering notch 402 to move to a closed position (as in FIG. 6B). The effective area of the inlet port metering notch 402 may also be adjusted by the transmission of an electronic control signal to an electronic actuator or by the transmission of fluidic pressure to a hydraulic or pneumatic actuator in order to cause the valve spool 508 to move to a position in which the area adjustment valve 502 is in an open position (as in FIG. 6A) or closed position (as in FIG. 6B).

At step 720, the pumping chamber 202 is rotated across the inlet port metering notch 402 in order to bring the pumping chamber 202 into fluidic communication with the inlet port 302. As the pumping chamber 202 comes into fluidic communication with the inlet port 302, the plunger 204 in the pumping chamber barrel 206 moves away from the inlet port 302 and draws hydraulic fluid into the pumping chamber 202. This process continues as the pumping chamber rotates across the extent of the inlet chamber 302 at step 730. During step 730, the pumping chamber 202 rotates from a leading edge of the inlet port 302 to a trailing edge of the inlet port 302. At the end of step 730, the pumping chamber 202 has moved into transition area 310.

At step 740, the pumping chamber 202 is rotated about the central axis 214 of the pump 200 and towards the discharge port 304. At step 750, the effective area of the discharge port metering notch 402 is adjusted by actuating the area adjustment valve 502. For example, the effective area of the inlet port metering notch 402 can be automatically adjusted as the result of the pressure of hydraulic fluid in communication with the discharge port metering notch 402 exerting a force on the valve spool 508 thereby causing the discharge port metering notch 402 to move to a closed position (as in FIG. 6B). The effective area of the discharge port metering notch 402 may also be adjusted by the transmission of an electronic control signal to an electronic actuator or by the transmission of fluidic pressure to a hydraulic or pneumatic actuator in order to cause the valve spool 508 to move to a position in which the area adjustment valve 502 is in an open position (as in FIG. 6A) or closed position (as in FIG. 6B).

At step 760, the pumping chamber 202 is rotated across the discharge port metering notch 402 in order to bring the pumping chamber 202 into fluidic communication with the discharge port 304. As the pumping chamber 202 comes into fluidic communication with the discharge port 302, the plunger 204 in the pumping chamber barrel 206 moves towards the discharge port 304 and thereby expels hydraulic fluid from the pumping chamber 202 through the discharge port 304 and into the outlet passage 108. This process continues as the pumping chamber rotates across the extent of the discharge port 304 at step 770. During step 770, the pumping chamber 202 rotates from a leading edge of the discharge port 304 to a trailing edge of the discharge port 304. At the end of step 770, the pumping chamber 202 has moved into transition area 308.

Figure 8:
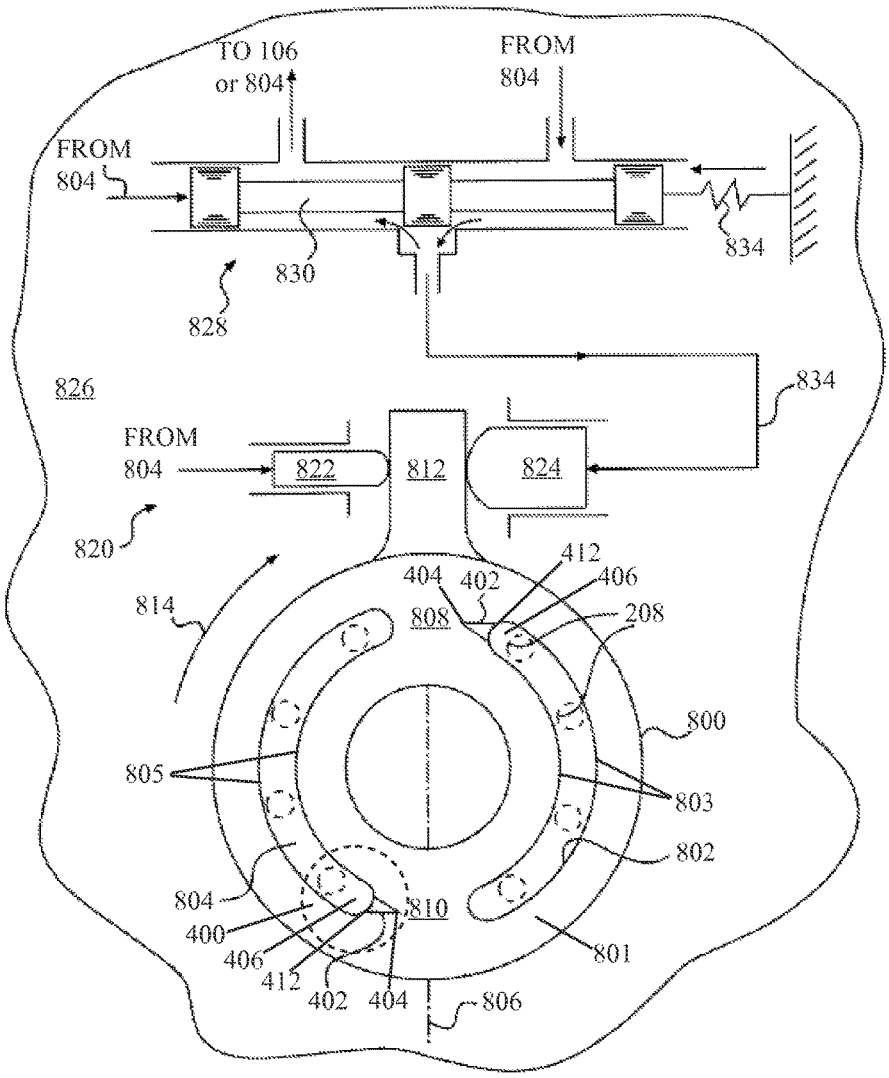
FIG. 8 is a schematic illustration of an alternative port plate that may form a portion of the pump of FIG. 2 along with additional hydraulic circuit components in accordance with the disclosure.

FIG. 8 is a schematic illustration of an alternative port plate that may form a portion of the pump of FIG. 2 along with additional hydraulic circuit components in accordance with the disclosure. The rotatable port plate 800 includes a number of features analogous to those features of the port plate 300 depicted in FIG. 3. The rotatable port plate 800 includes a port plate body 801 (which from the perspective of FIG. 8, extends into or out of the page) a generally arcuate inlet port 802 (which includes side walls 803 that extend into, and possibly through, the port plate body 801) located on one side of tilt axis 806, and a similar generally arcuate discharge port 804 (which includes side walls 805 that extend into, and possibly through, the port plate body 801) located on the opposite side of the tilt axis 806. Metering notches 402 are provided at a leading edge 406 of each of the inlet port 802 and the discharge port 804. In alternative embodiments, a rotatable port plate may be provided that only has a metering notch at a leading edge of one of an inlet port or a discharge port. Similarly, alternative embodiments may include additional metering notches at a leading edge of any additional inlet port or inlet port segment or at a leading edge of any additional discharge ports or discharge port segment. The metering notches 402 may help to reduce a shock loading associated with the transitioning of the passageways 208 into and out of fluidic communication with each of the inlet port 802 and the discharge port 804. Furthermore, metering notches 402 include effective area adjustment passages 404 that allow the effective area of the metering notch 402 to be increased, by various amounts, beyond the actual area of the metering notch 402, e.g. an area of a boundary between a groove, or channel, machined into the port plate body 801 and one of the inlet port 802 or the discharge port 804. The enlarged port plate section 400 of FIG. 4 that shows the metering notches 402 with increased detail corresponds to the section 400 of the rotatable port plate 800.

As body 216 and associated pumping chambers 202 rotate relative to the rotatable port plate 800 (e.g., rotate clockwise in FIG. 8), passageways 208 (the projections of which at a single point in time are displayed in FIG. 8) may move into and out of fluid communication with the inlet port 802 and the discharge port 804. Plungers 204 may reach a top-dead-center (TDC) position during a discharge stroke at a transition area 808 located between a trailing end of discharge port 804 and a leading end of inlet port 802, and reach a bottom-dead-center (BDC) position during an intake stroke at a transition area 810 located between a trailing end of inlet port 802 and a leading end of discharge port 804.

Transition areas 808 and 810 may generally be aligned with tilt axis 806. However, the alternative port plate depicted in FIG. 8 is a rotatable port plate 800 that can be rotated such that transition areas 808 and 810 are moved out of alignment with the tilt axis 810. When the transition areas 808 and 810 are moved in the direction of arrow 814, or in the opposite direction, such that they are no longer aligned with tilt axis 806, pressurized fluid within the pumping chambers 202 can act on the transition areas 808 and 810 to generate a reactive force that results in a swivel torque being applied to the swashplate 220 and thereby facilitates a change in the tilt angle of the swashplate 220. In this manner, an amount of rotation of the port plate 800 in a particular direction can be controlled to generate a particular swivel torque and resulting tilt angle change of the swashplate 220. In order to facilitate the rotation of the rotatable port plate 800, the rotatable port plate 800 includes an extension, or tab, 812 that can be acted upon by actuator 820. However, in alterative embodiments the rotatable port plate 800 can include various other actuator engagement interfaces.

The additional hydraulic circuit components depicted in FIG. 8, which include the actuator 820, are configured to facilitate rotation of the rotatable port plate 800. The actuator 820 may be configured to selectively rotate the rotatable port plate 800 relative to tilt axis 806, thereby changing a reactive force on plungers 204 that is generated by fluid trapped within chambers 202 as plungers 204 pass through transition areas 808, 810. Actuator 820 includes a biasing piston 822 and an actuator piston 824. Biasing piston 822 may be disposed within housing 826 and arranged to push on one side of a protrusion, for example the tab 812, that protrudes radially outward from a periphery of the rotatable port plate 800. Actuator piston 824 may also be disposed within housing 826 and arranged to push on a side of tab 812 opposite biasing piston 822. The force exerted by biasing piston 822 on tab 812 can cause the rotatable plate 800 to rotate in a direction generally aligned with the rotational direction of the body 216 (e.g., shown as clockwise in FIG. 8 via the arrow 814), while the force exerted by actuator piston 824 on tab 812 can cause the rotatable port plate 800 to rotate in a direction generally opposite the rotational direction of the body 216. In the embodiment depicted in FIG. 8, the biasing piston 822 is located on the same side of the tilt axis 806 as the discharge port 804, and have a pressure area exposed to pressurized fluid from discharge port 804. However, in alternative embodiments, the force exerted by the biasing piston 822 may be controlled electronically or otherwise through exposure to an alternative pressure source. In the embodiment depicted in FIG. 8, the biasing piston 824 is located on the same side of the tilt axis 806 as the inlet port 802, and has a pressure area larger than the pressure area of the biasing piston 822. The pressure area of actuator piston 824 may be selectively exposed to either pressurized fluid from the discharge port 804 or fluid from a low-pressure source (e.g., from the tank 106 or the inlet port 802). When the actuator piston 824 is exposed to pressurized fluid from the discharge port 804, the force generated by actuator piston 824 may be greater than the force generated by biasing piston 822 and the rotatable port plate 800 may be caused to rotate in the direction opposite arrow 814. When the actuator piston 824 is fluidly communicated with the low-pressure source, the force generated by actuator piston 824 may be less than the force generated by the biasing piston 822 and the rotatable port plate 800 may be caused to rotate in the direction of the arrow 814.

A pressure control valve 828 may be associated with the actuator 820 and configured to regulate the control pressure of the actuator piston 824, thereby controlling in which direction the rotatable port plate 800 is rotated by the actuator 820 and in which direction the swashplate 220 is subsequently tilted. In the embodiment depicted in FIG. 8, the pressure control valve 828 may include a 3-position valve element 830 that is movable between a first position at which high-pressure fluid from the discharge port 804 is communicated with actuator piston 824 via a passage 832, and a second position at which actuator piston 824 is fluidly communicated with the low-pressure source (i.e., with tank 106 or inlet port 802) via passage 832. Pressure control valve 828 may be spring biased toward the first position by spring 834.

INDUSTRIAL APPLICABILITY

The present disclosure is applicable to hydraulic pumps and, more specifically, to swashplate-type axial piston pumps that interface with inlet and outlet passages through a port plate having metering notches with an adjustable effective area. A swashplate-type axial piston pump is depicted in FIG. 2, port plates of the swashplate-type axial piston pump having metering notches with an adjustable effective area are depicted in FIGS. 3 and 8, and a metering notch effective area adjustment is depicted in FIG. 5. During operation, as the pumping chambers 202 of the swashplate-type axial piston pump 200 come into and out of fluidic communication with the inlet and outlet passages 104, 108 through inlet and outlet passages 302, 304 of the port plate 300 (or through inlet and outlet passages 802 and 804 of the port plate 800), pressure spikes are created that can propagate through the hydraulic system and cause damage to various components. The metering notch effective area adjustment allows for the size of the metering notches 402 on the port plate 300 to be selected to match the operating conditions of the pump 200 in order to mitigate the impact of such pressure spikes. Additionally, as the pumping chambers 202 rotate with respect to the swashplate 220, the forces acting on the slipper feet 218 (which are configured to slide along plunger engagement surface 224 of the swashplate 220) vary as the pumping chambers 202 come into and out of fluidic communication with the inlet and outlet passages 302, 304 of the port plate 300 (or the inlet and outlet passages 802, 804 of the rotatable port plate 800). The metering notch effective area adjustment allows for the effective area of the metering notches 402 to be selected to match the operating conditions of the pump 200 in order to ensure that the forces acting on the slipper feet 218 will lead to effective operation of the pump 200 at various operating pressures.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

What is claimed is:

1. A port plate for a swashplate type axial piston pump, the port plate comprising:

a port plate body;

a port extending through the port plate body, wherein the port is an inlet port or a discharge port;

a first metering notch comprising a channel in the port plate body, the first metering notch being in fluidic communication via a first area adjustment passage with a first area adjustment valve configured to adjust the effective area of the first metering notch, wherein the first metering notch is disposed at a leading edge of the port;

wherein the first area adjustment valve is fluidly connected via a second area adjustment passage with the leading edge of the port, such that when the swashplate type axial piston pump is in operation, oil may flow from the first metering notch, through the first area adjustment valve and through the second area adjustment passage into the port when the first area adjustment valve is in an open position.

2. The port plate of claim 1, wherein the first area adjustment valve increases the effective area of the first metering notch when in an open position.

3. The port plate of claim 2, wherein the first area adjustment valve is biased to the open position by a spring.

4. The port plate of claim 3, wherein pressurized fluid within the second area adjustment passage biases the first area adjustment valve to a closed position from the open position.

5. The port plate of claim 4, wherein the first area adjustment valve is in the open position when the pressure of the pressurized fluid within the second area adjustment passage is below an opening threshold, and wherein the first area adjustment valve is in a closed position when the pressure of the pressurized fluid within the second area adjustment passage is above a closing threshold.

6. The port plate of claim 2, wherein the first area adjustment valve is a solenoid valve.

7. The port plate of claim 1, wherein the first area adjustment valve is disposed in a cavity within the port plate body.

8. The port plate of claim 1, further comprising a second metering notch in fluidic communication via a third area adjustment passage with a second area adjustment valve configured to adjust the effective area of the second metering notch, wherein the second metering notch is disposed at a leading edge of the other of the inlet port or the discharge port at which the first metering notch is disposed.

9. A swashplate-type axial piston pump comprising:

a swashplate;

a plurality of pumping chambers, each pumping chamber including:

a plunger connected to the swashplate via a slipper foot configured to slide along a plunger engagement surface of the swashplate, and a pumping chamber barrel in which an associated plunger undergoes reciprocal motion; and a port plate including:

a port plate body;

a port extending through the port plate body, wherein the port is an inlet port or a discharge port;

a first metering notch comprising a channel in the port plate body, the first metering notch being in fluidic communication via a first area adjustment passage with a first area adjustment valve configured to adjust the effective area of the first metering notch, wherein the first metering notch is disposed at a leading edge of the port; and wherein the first area adjustment valve is fluidly connected via a second area adjustment passage with the leading edge of the port such that oil may flow from the first metering notch, through the first area adjustment valve and through the second area adjustment passage into the port when the first area adjustment valve is in an open position.

10. The swashplate-type axial piston pump of claim 9, wherein the first area adjustment valve increases the effective area of the first metering notch when in the open position.

11. The swashplate-type axial piston pump of claim 10, wherein the first area adjustment valve is biased to the open position by a spring.

12. The swashplate-type axial piston pump of claim 11, wherein pressurized fluid within the second area adjustment passage biases the first area adjustment valve to a closed position.

13. The swashplate-type axial piston pump of claim 12, wherein the first area adjustment valve is in the open position when the pressure of the pressurized fluid within the second area adjustment passage is below an opening threshold, and wherein the first area adjustment valve is in the closed position when the pressure of the pressurized fluid within the second area adjustment passage is above a closing threshold.

14. The swashplate-type axial piston pump of claim 10, wherein the first area adjustment valve is a solenoid valve.

15. The swashplate-type axial piston pump of claim 9, wherein the first area adjustment valve is disposed in a cavity within the port plate body.

16. The swashplate-type axial piston pump of claim 9, further comprising a second metering notch comprising a channel in the port plate body, the second metering notch being in fluidic communication via a third area adjustment passage with a second area adjustment valve configured to adjust the effective area of the second metering notch, wherein the second metering notch is disposed at a leading edge of the other of the inlet port or the discharge port at which the first metering notch is disposed.

17. A method for operating a swashplate-type axial piston pump, the method comprising:

rotating a pumping chamber about a central axis of the swashplate-type axial piston pump and towards an inlet port of a port plate;

adjusting an effective area of an inlet port metering notch by controlling an inlet port metering notch area adjustment valve actuator;

rotating the pumping chamber across the inlet port metering notch and into fluidic communication with the inlet port; and rotating the pumping chamber across the inlet port while drawing fluid through the inlet port and into the pumping chamber.

18. The method of claim 17, further comprising:

rotating the pumping chamber about the central axis of the swashplate-type axial piston pump and towards a discharge port of the port plate;

adjusting an effective area of a discharge port metering notch by controlling a discharge port metering notch area adjustment valve actuator;

rotating the pumping chamber across the discharge port metering notch and into fluidic communication with the discharge port; and rotating the pumping chamber across the discharge port while expelling fluid through the discharge port and into an outlet passage.

19. The method of claim 17, wherein rotating the pumping chamber across the inlet port while drawing fluid through the inlet port and into the pumping chamber comprises retracting a plunger from an approximate bottom-dead-center position to an approximate top-dead-center position as the pumping chamber moves from a leading edge of the inlet port to a trailing edge of the inlet port.

20. The method of claim 18, wherein rotating the pumping chamber across the discharge port while expelling fluid through the discharge port and into the outlet passage comprises extending a plunger from an approximate top-dead-center position to an approximate bottom-dead-center position as the pumping chamber moves from a leading edge of the discharge port to a trailing edge of the discharge port.

* * * * *